US008499385B2

(12) United States Patent
Horitani

(10) Patent No.: US 8,499,385 B2
(45) Date of Patent: Aug. 6, 2013

(54) ELECTRICALLY OPERATED BED AND METHOD FOR CONTROLLING SAME

(75) Inventor: Masao Horitani, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 382 days.

(21) Appl. No.: 12/449,719

(22) PCT Filed: Jan. 30, 2008

(86) PCT No.: PCT/JP2008/051438

§ 371 (c)(1),
(2), (4) Date: Aug. 24, 2009

(87) PCT Pub. No.: WO2008/111334

PCT Pub. Date: Sep. 18, 2008

(65) Prior Publication Data

US 2010/0011505 A1 Jan. 21, 2010

(30) Foreign Application Priority Data

Mar. 12, 2007 (JP) ..... 2007-062572

(51) Int. Cl.
*A47B 7/02* (2006.01)

(52) U.S. Cl.
USPC ..... 5/616; 5/618

(58) Field of Classification Search
USPC ..... 5/600, 613, 616, 617, 618
See application file for complete search history.

(56) References Cited

U.S. PATENT DOCUMENTS 5,611,096 A * 3/1997 Bartlett et al. ..... 5/617
5,771,511 A 6/1998 Kummer
5,787,528 A * 8/1998 Antinori ..... 5/616
6,008,598 A * 12/1999 Luff et al. ..... 318/16
6,957,460 B2 10/2005 Horitani
7,058,999 B2 * 6/2006 Horitani et al. ..... 5/618
2004/0064891 A1 4/2004 Horitani
2004/0133982 A1 7/2004 Horitani et al.

FOREIGN PATENT DOCUMENTS

| | | |
|---|---|---|
| EP | 1374821 | 1/2004 |
| EP | 1413281 | 4/2004 |
| JP | 2001-37820 | 2/2001 |
| JP | 2004-141437 | 5/2004 |
| JP | 2004-159805 | 6/2004 |

OTHER PUBLICATIONS

European Search Report dated Mar. 18, 2010.

* cited by examiner

*Primary Examiner* — Robert G Santos
*Assistant Examiner* — Nicholas Polito
(74) *Attorney, Agent, or Firm* — McGinn IP Law Group, PLLC

(57) ABSTRACT

A control unit controls a drive unit so that a back angle α, which is an elevation angle of a back bottom, and a knee angle β, which is an elevation angle of a knee bottom, change according to a pre-set pattern. The control unit comprises a memory unit for storing a plurality of patterns of linking a coordinate point (0,0) in a (α,β) coordinate, in which each of the bottoms is in a horizontal state, and a coordinate point ($\alpha_0$, $\beta_0$), in which the back bottom is raised, with a plurality of points; a selection unit for selecting one pattern from the plurality of patterns stored in the memory unit; and a computation unit for controlling the drive unit so that the back angle α and the knee angle β change according to the pattern selected by the selection unit. Therefore, the patient can be prevented from being displaced on the bed and from being subjected to a sense of pressure on their stomach or chest.

7 Claims, 17 Drawing Sheets

$(\alpha, \beta)=(40, 25)$ $(\alpha, \beta)=(19, 25)$

ELECTRICALLY OPERATED BED AND METHOD FOR CONTROLLING SAME

TECHNICAL FIELD

The present invention relates to an electrically operated bed for use as a nursing care bed or the like, a back section of which able to be raised electrically; and relates in particular to an electrically operated bed (as well as to a method for controlling same, and an apparatus for controlling same) whose back section can be raised when a patient is in a lying state without their being displaced or subjected to a sense of pressure.

BACKGROUND ART

As our society ages, the number of patients confined to their beds is increasing. Such patients may require their upper body to be lifted to an upright position on his/her bed for a medical procedure or a meal, or for watching TV, reading a book, or a similar activity. There have accordingly been developed electrically operated beds, whose back bottom and knee bottom can be electrically raised or lowered. However, raising or lowering the back of the electrically operated bed result in the patient's body being subjected to a displacement or a force. A result is that a displacement occurs between muscles and skin, thin blood vessels connecting the muscles and skin are stretched so that the blood vessels become more susceptible to an obstruction or a circulatory disorder, and a skin disorder occurs. Also, when the body of a bedridden patient whose position has shifted due to back-raising and back-lowering needs to be returned to its original position by a carer, a large burden will be placed on the carer because the patient is unable to move on his/her own accord.

For other patients who are not bedridden, raising their upper body on a bed when they have to be moved from the bed to a wheelchair readily allows the patient to assume a seated position on the bed, which in turn allows them to move more readily to the wheelchair. It is again preferable for the patient's body not to be subject to any displacement or force when their upper body is being raised in such an instance.

Accordingly, there has been disclosed a method for controlling back-knee coordinated movement for an electrically operated bed with back-raising and knee-raising capabilities, in which the user-friendliness of the bed is improved by varying the timings of electrically driven back-raising and knee-raising motions, and ensuring that the angle between the back bottom and the knee bottom does not become smaller than necessary (Patent document 1).

Patent document 1: Japanese Laid-open Patent Publication No. 2001-37820

Patent document 2: Japanese Patent No. 3707555

DISCLOSURE OF THE INVENTION

Problems the Invention is Intended to Solve

However, in the prior art described in the above reference, the technique basically comprises separate back-raising and back-lowering operations, even though the back-raising and knee-raising motions are controlled independently. Specifically, an operator (carer) starts and stops the back-raising motion, and starts and stops the knee-raising motion. In order to prevent the back-raising motion from displacing the position of the patient, the back bottom is therefore raised after the knee bottom is raised by 20 to 30°. Although the initial objective of the prior art is achieved, such an operation by the carer does not necessarily satisfactorily prevent the displacement during the back-raising motion, since the operation is subjective on the part of the carer. Also, the patient is not necessarily prevented from feeling a sense of pressure during back-raising and back-lowering operations.

The inventor of the present invention proposed an electrically operated bed capable of back-raising and back-lowering motions that does not depend on the subjectivity of the carer, and does not cause the patient to feel a sense of pressure. The inventor achieved this by changing the back angle and the knee angle according to a specified pattern. An application for a patent for the electrically operated bed was made, and the patent was granted (Patent document 2). The initial objective of the invention was achieved; however, there exist physical differences between patients such as difference in body height, and differences between the beds themselves such as in the thickness of mattresses. Therefore, the invention does not necessary enable an optimum pattern for back-raising and back-lowering operations to be performed when a similar physical attribute (of the patient), attribute of the mattress, or another attribute exist.

An object of the present invention is to provide an electrically operated bed and a method for controlling same, whereby a patient can be reliably prevented from being displaced on a bed when a back bottom is being raised (back raising operation) and when the back bottom is being lowered to a horizontal position (back lowering operation), the patient can be prevented from being subjected to a sense of pressure on their stomach or chest, and the burden on both patient and carer alike can be reduced during the operation. This object can be achieved even in instances where there is variation in terms of the physical attributes of the patient or the attributes of the mattress, and even without having to rely on the subjectivity on the part of a carer.

Means for Solving the Problems

An electrically operated bed according to the present invention comprising a back bottom; a knee bottom; a drive unit for swinging the back bottom and the knee bottom up or down; and a control unit for controlling the drive unit so that a back angle $\alpha$, which is an angle of elevation of the back bottom from a horizontal state, and a knee angle $\beta$, which is an angle of elevation of the knee bottom from a horizontal state, change according to a pre-set pattern;

wherein the control unit comprises a memory unit for storing a plurality of patterns for linking, with a plurality of points, a coordinate point (0,0) in an $(\alpha,\beta)$ coordinate, in which each of the bottoms is in a horizontal state, and a coordinate point $(\alpha_0, \beta_0)$, in which the back bottom is raised; a selection unit for selecting one pattern from the plurality of patterns stored in the memory unit; and a computation unit for controlling the drive unit so that the back angle $\alpha$ and the knee angle $\beta$ change according to the pattern selected by the selection unit.

A method for controlling an electrically operated bed according to the present invention is a method for controlling pivoting of a back bottom and a knee bottom of an electrically operated bed having a vertically pivoting back bottom and a knee bottom, wherein the method comprising the step of: driving the back bottom and the knee bottom so as to change a back angle $\alpha$, which is an angle of elevation of the back bottom from a horizontal state, and a knee angle $\beta$, which is an angle of elevation of the knee bottom from a horizontal state, according to a pre-set pattern, a plurality of patterns are prepared, the patterns linking a coordinate point (0,0) in which the back bottom and the knee bottom are in a horizontal state, and a coordinate point ($\alpha_0$, $\beta_0$) in which the back bottom is raised, where a combination of the $\alpha$ and the $\beta$ is expressed using a ($\alpha$,$\beta$) coordinate; the pre-set pattern is selected from the plurality of patterns; and the pivoting of the back bottom and the knee bottom is controlled so that the back angle $\alpha$ and the knee angle $\beta$ change according to the selected pre-set pattern.

According to the electrically operated bed and the method for controlling same, each of the plurality of patterns may differ depending the body height or other bodily attribute of a user of the bed, a type, characteristic, or other attribute of a mattress, the coordinate point ($\alpha$,$\beta$) by which the back bottom is raised, or a combination of the above.

Effects of the Invention

According to the present invention, a plurality of patterns is provided, a pattern that is most suitable for the patient or the bedding is selected from the plurality of patterns, and pivoting of the back bottom and the knee bottom is controlled according to the most suitable pattern. Therefore, the back bottom and the knee bottom can always be operated in the most suitable pattern without having to depend on the subjectivity of the carer or another operator when the back bottom is being raised and when the back bottom is being lowered; therefore, the patient can be prevented from being displaced on the bed and from being subjected to a sense of pressure on their stomach or chest, and the burden on both patient and carer alike can be reduced during the operation.

KEY

Figure 1:
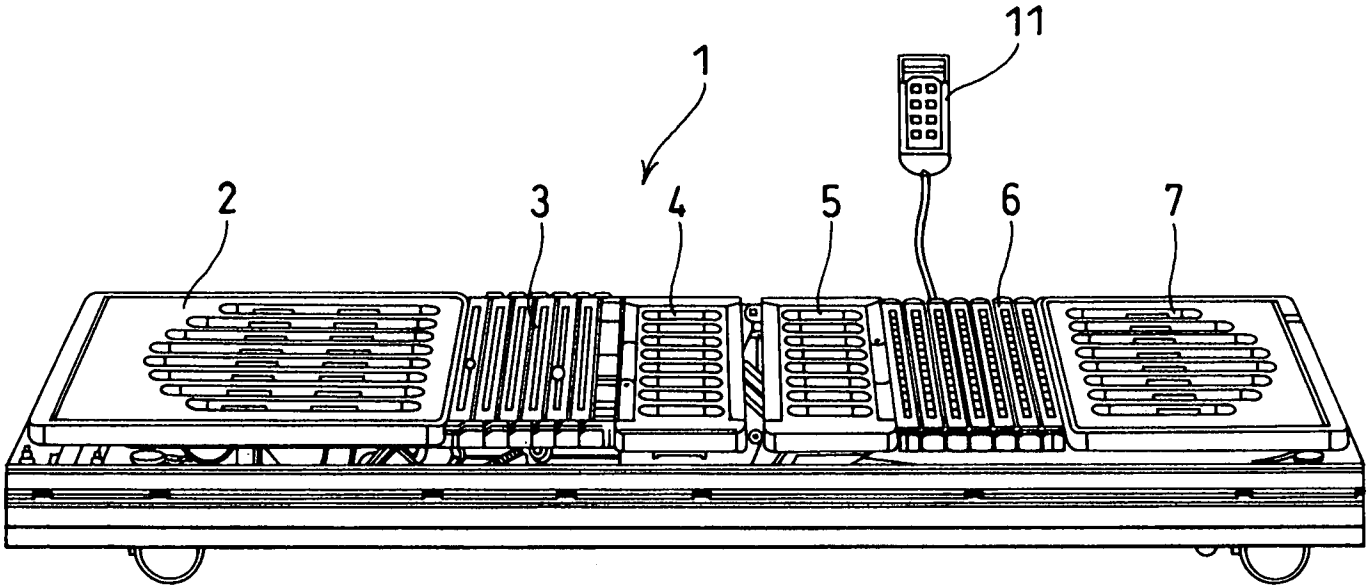
FIG. 1 is a perspective view showing the electrically operated bed according to an embodiment of the present invention.

1: electrically operated bed
2: back bottom
3: back bending portion
4: waist bottom
5: knee bottom
6: knee bending portion
7: feet bottom
11: control box
20: back-raising device
21: support rod
23, 24, 25, 26, 43: link
28, 45: actuator
40: knee-raising device
41, 42: support section
62: control unit
68, 69, 70: motor
71, 72, 73: sensor
81: memory unit
82: computation unit
83: selection unit

BEST MODE FOR CARRYING OUT THE INVENTION

Figure 2:
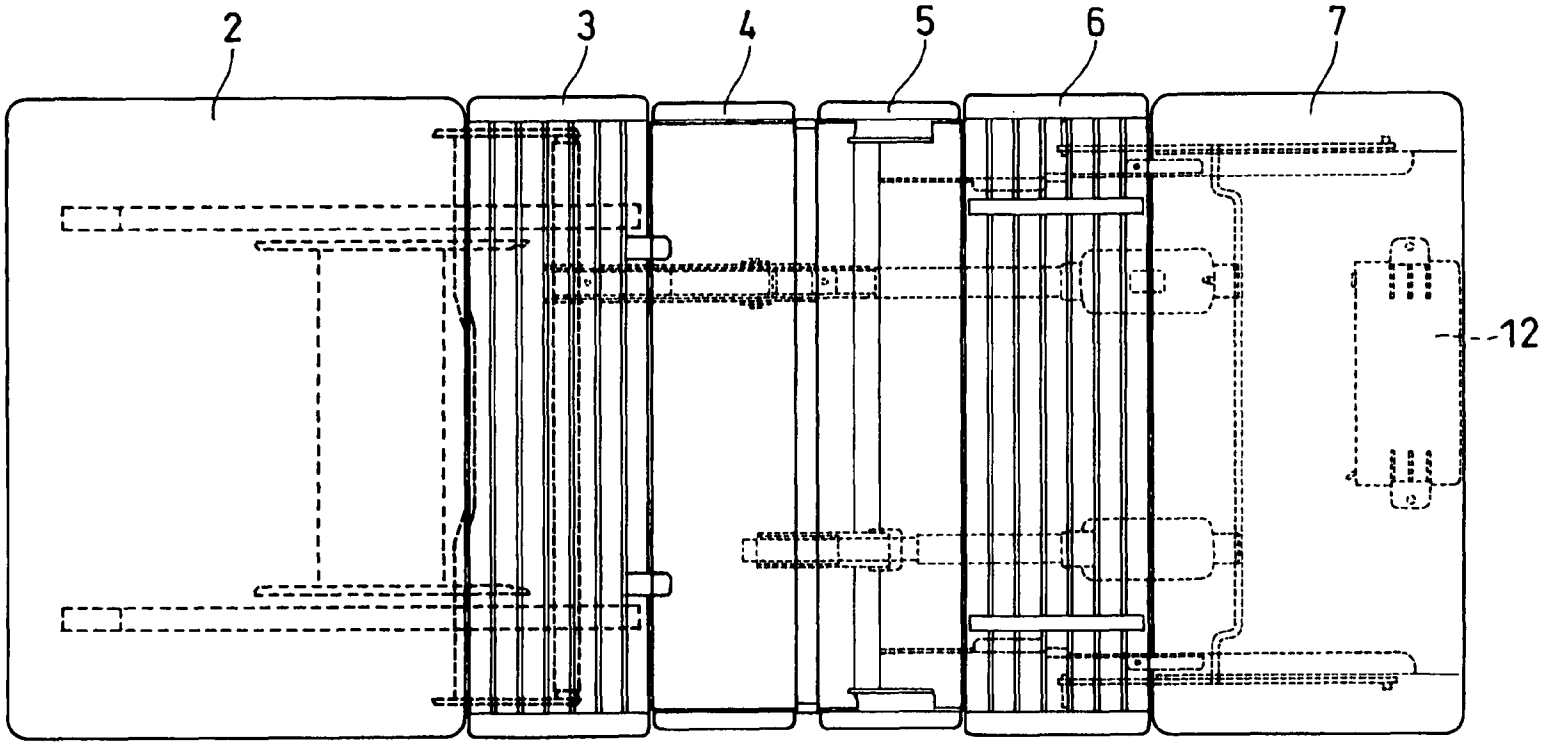
FIG. 2 is a top view showing a back bottom, a knee bottom, and a feet bottom of the electrically operated bed, as well as bending portions therebetween.
Figure 3:
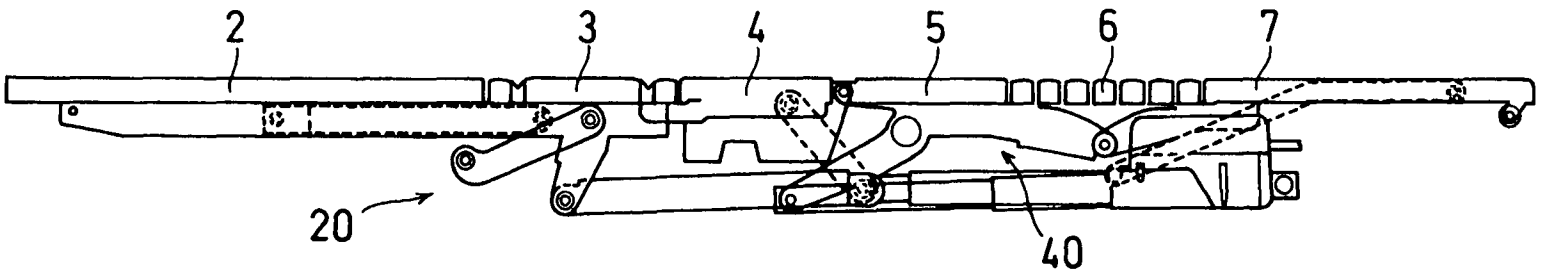
FIG. 3 is a front view of the portions shown in FIG. 2.
Figure 4:
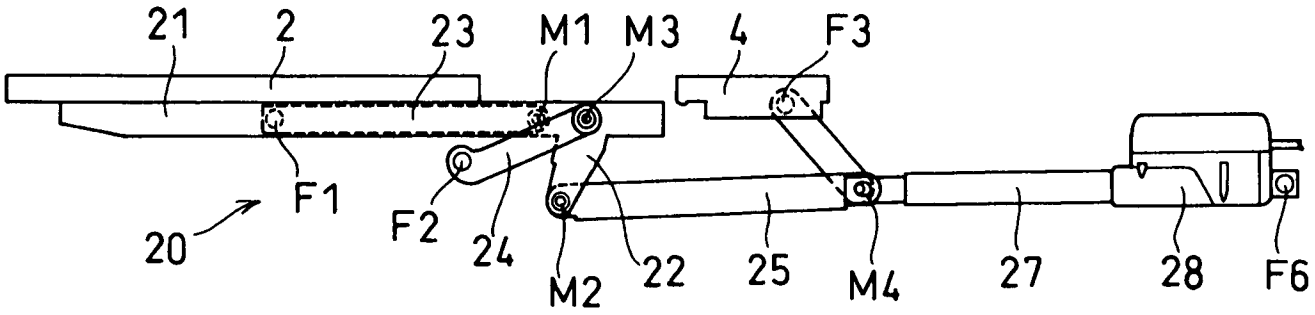
FIG. 4 is a front view showing a back-raising device when the back bottom is horizontal.
Figure 5:
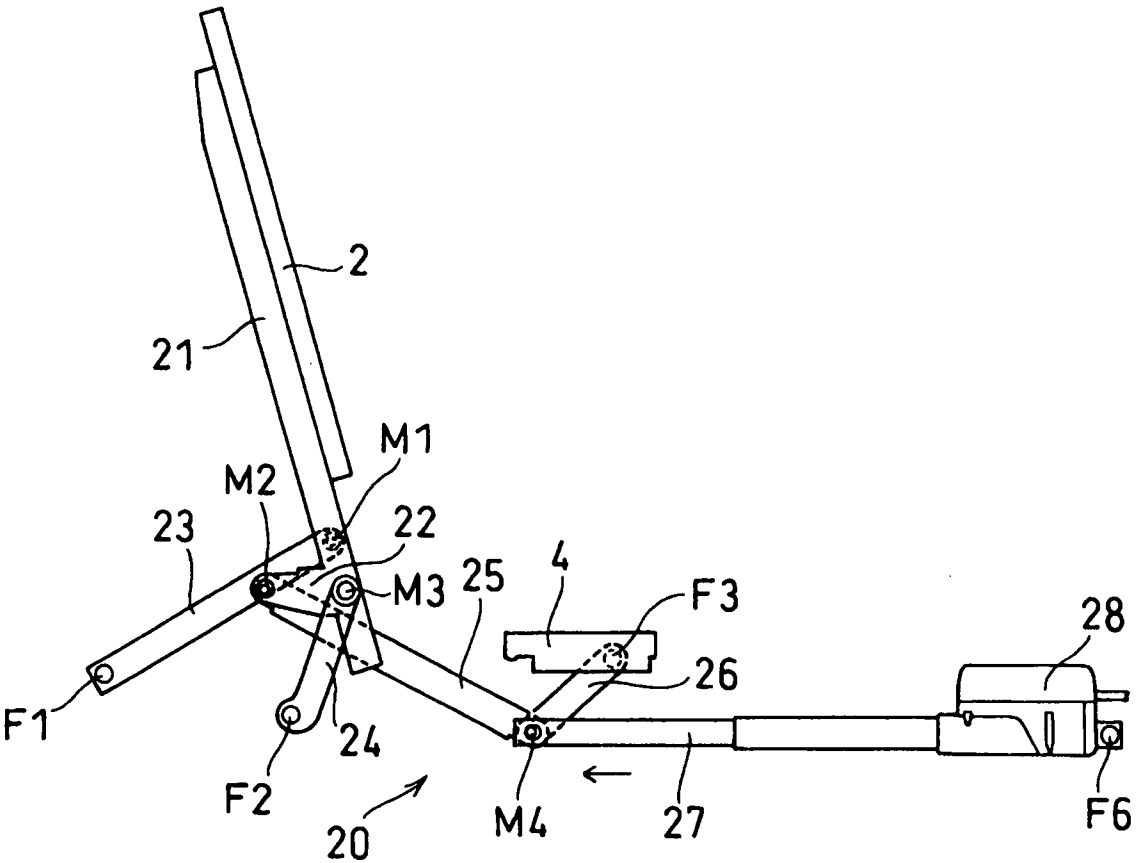
FIG. 5 is a front view showing a back-raising device when the back bottom is raised.
Figure 6:
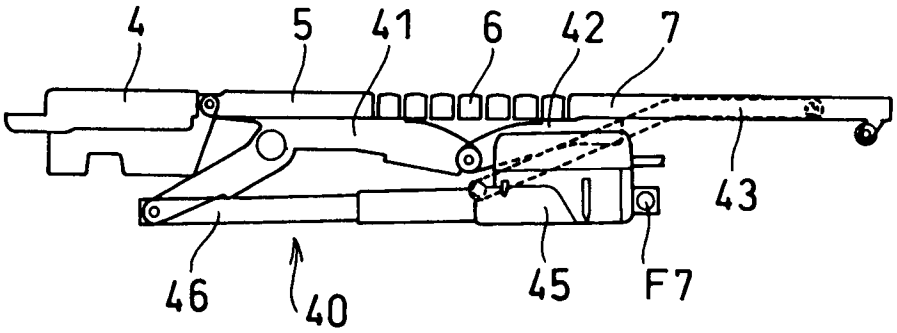
FIG. 6 is a front view showing a knee-raising device when the knee bottom is horizontal.
Figure 7:
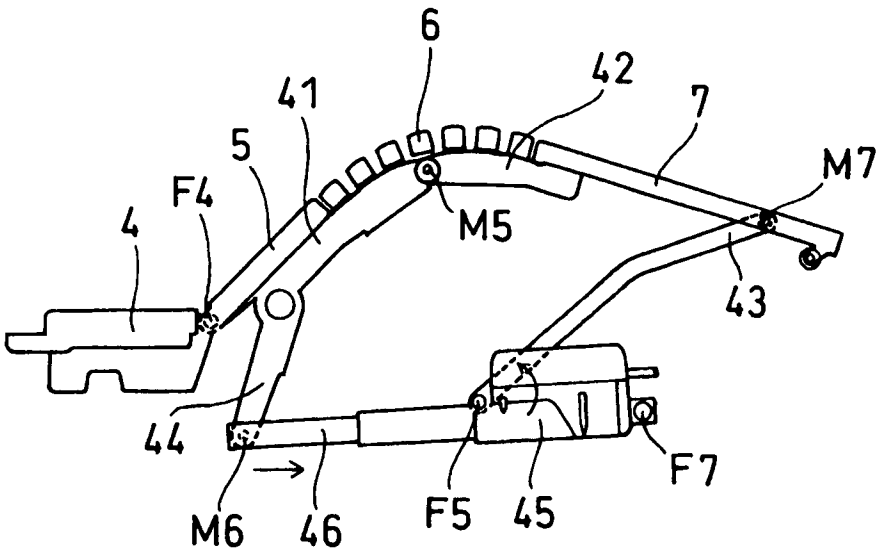
FIG. 7 is a front view showing a knee-raising device when the knee bottom is raised.
Figure 8:
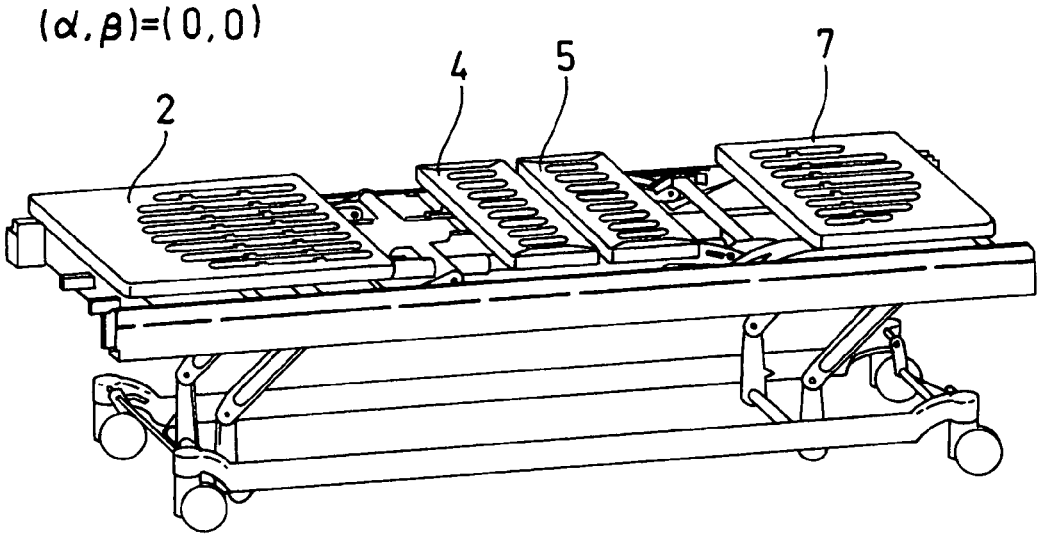
FIG. 8 is a perspective view showing an operation of the electrically operated bed, where the coordinate ($\alpha$,$\beta$) is (0,0)
Figure 9:
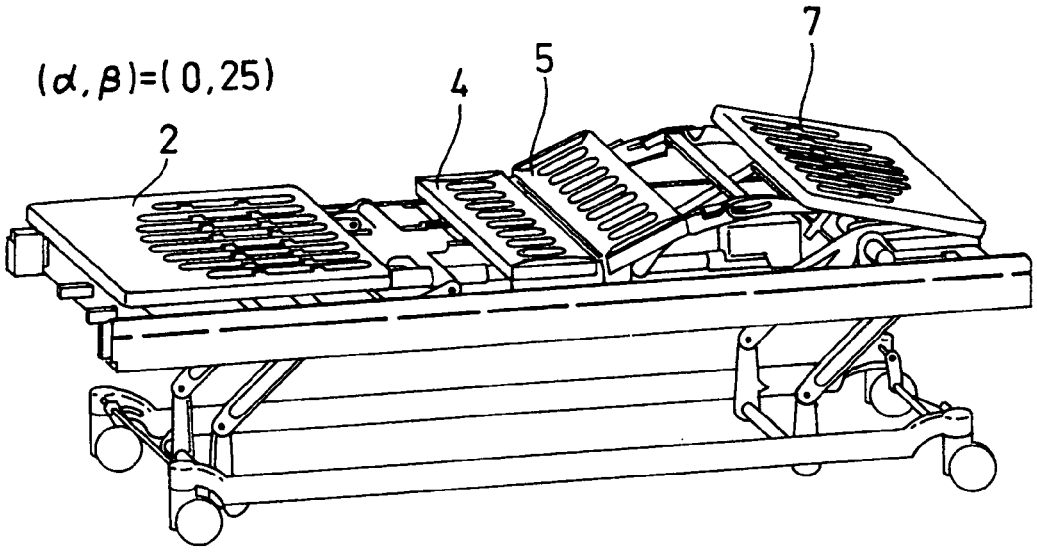
FIG. 9 is a perspective view showing an operation of the electrically operated bed, where the coordinate ($\alpha$,$\beta$) is (0,25)
Figure 10:
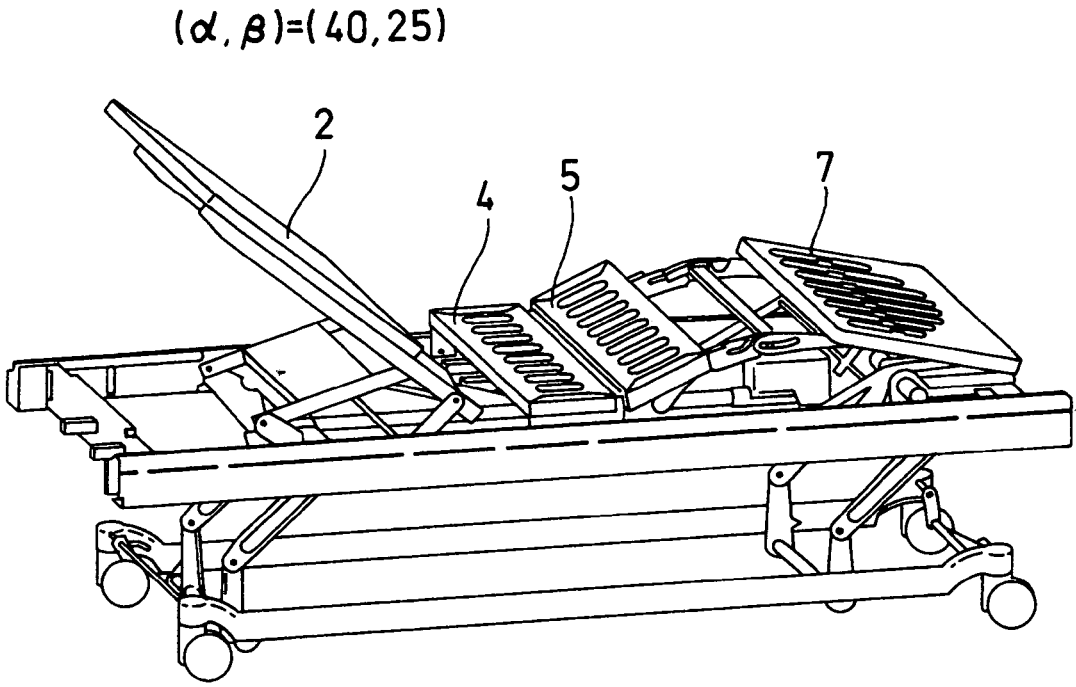
FIG. 10 is a perspective view showing an operation of the electrically operated bed, where the coordinate ($\alpha$,$\beta$) is (40, 25)
Figure 11:
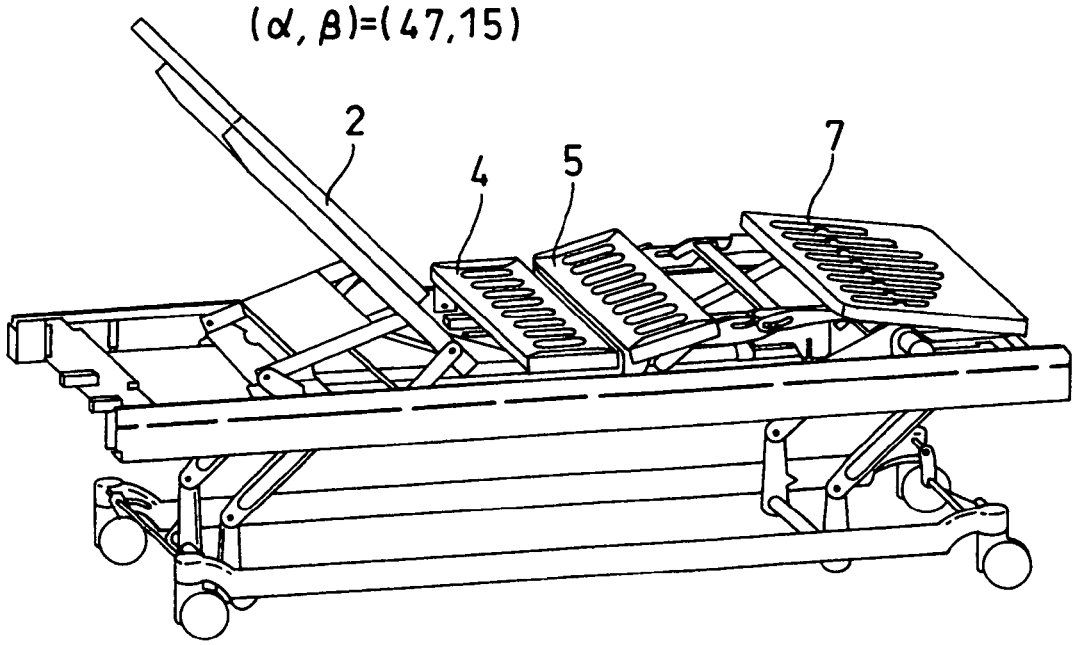
FIG. 11 is a perspective view showing an operation of the electrically operated bed, where the coordinate ($\alpha$,$\beta$) is (47, 15)
Figure 12:
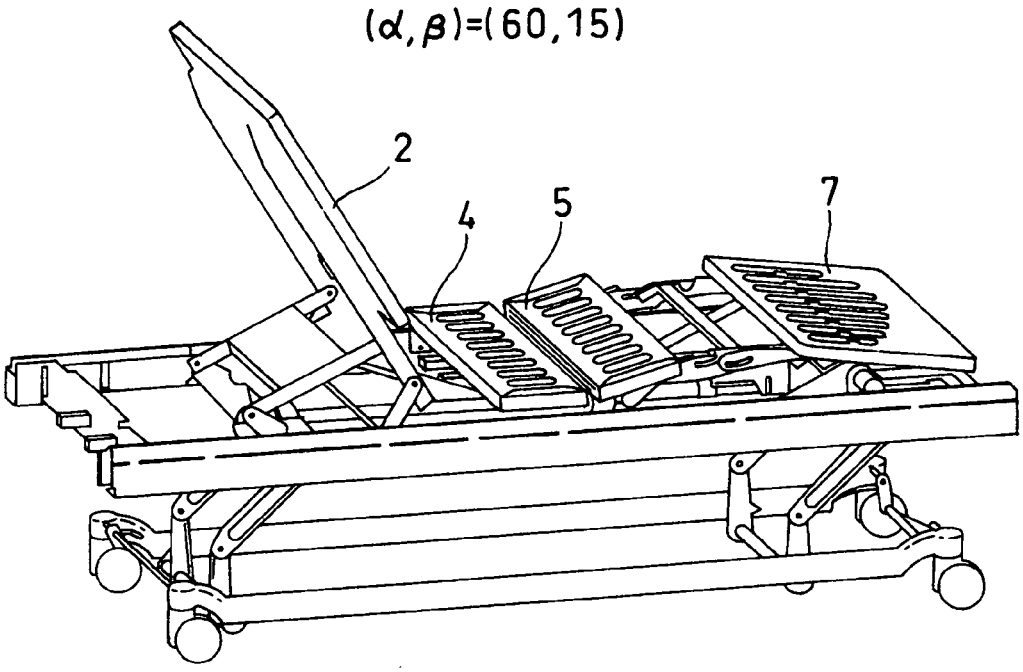
FIG. 12 is a perspective view showing an operation of the electrically operated bed, where the coordinate ($\alpha$,$\beta$) is (60, 15)
Figure 13:
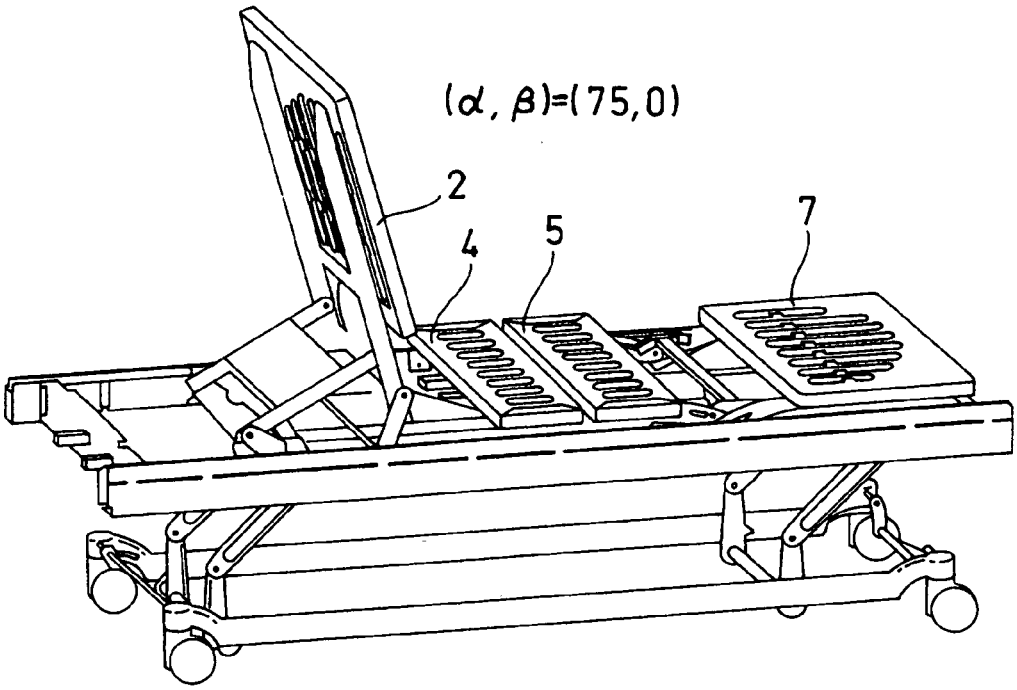
FIG. 13 is a perspective view showing an operation of the electrically operated bed, where the coordinate ($\alpha$,$\beta$) is (75, 0)
Figure 14:
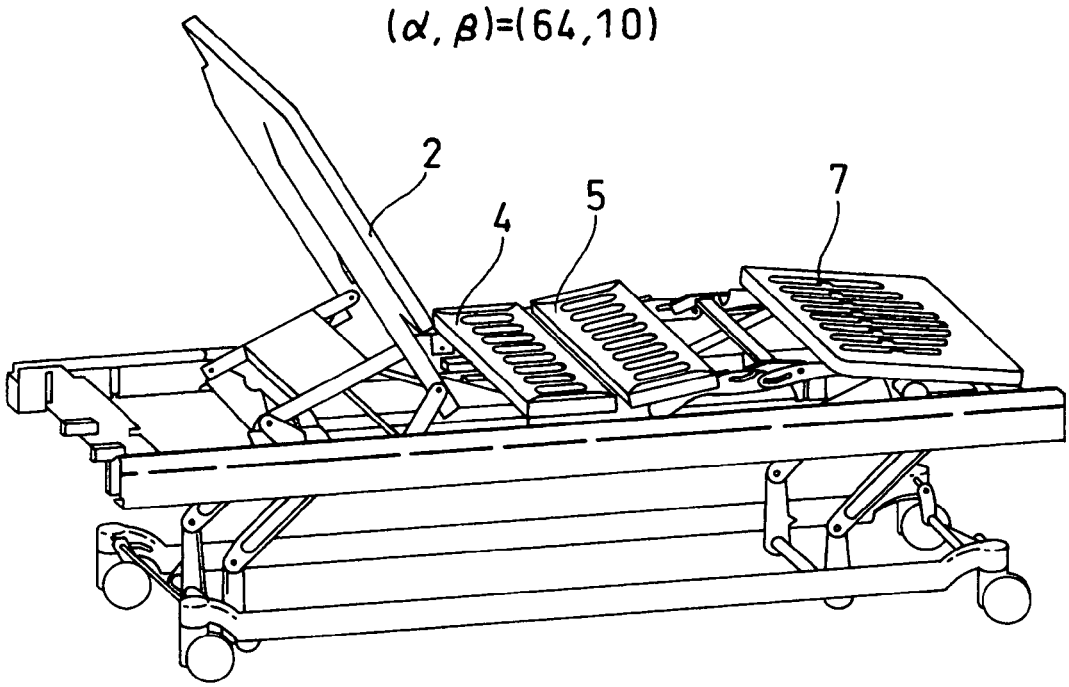
FIG. 14 is a perspective view showing an operation of the electrically operated bed, where the coordinate ($\alpha$,$\beta$) is (64, 10)
Figure 15:
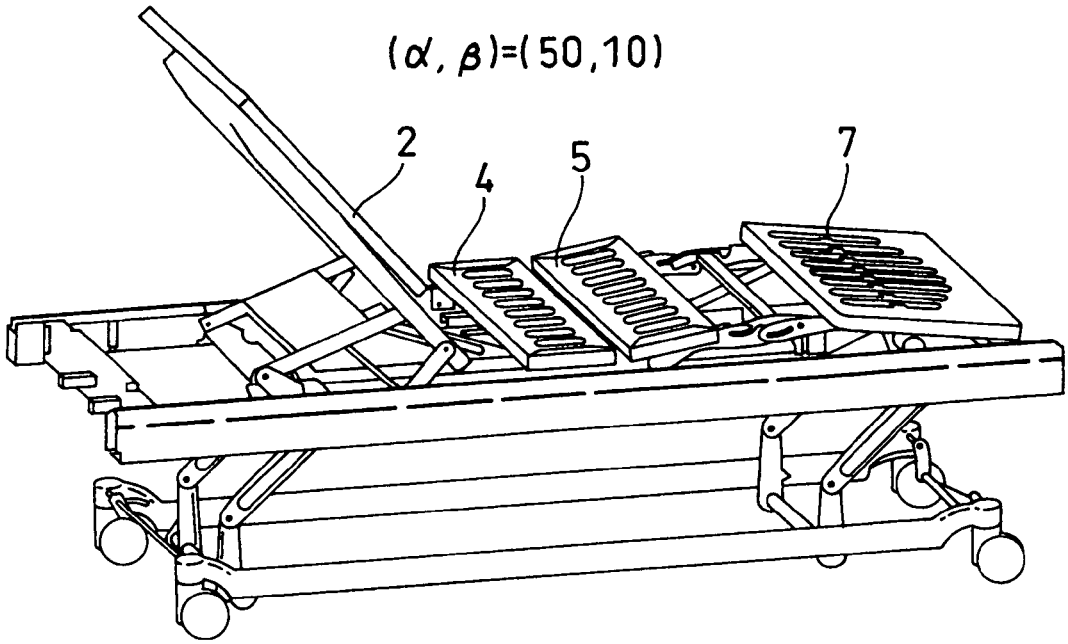
FIG. 15 is a perspective view showing an operation of the electrically operated bed, where the coordinate ($\alpha$,$\beta$) is (50, 10)
Figure 16:
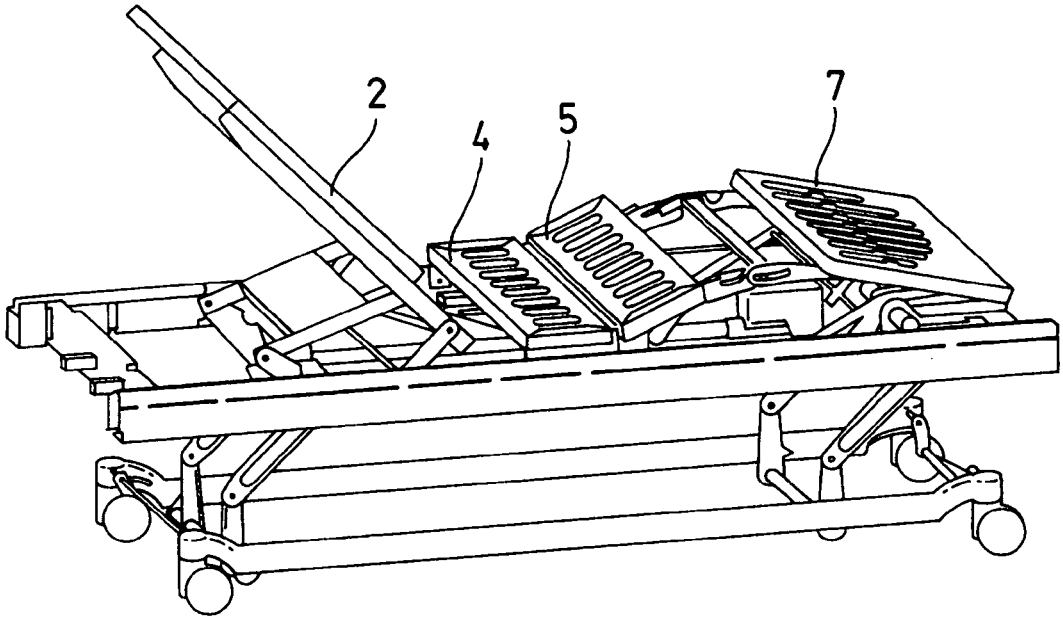
FIG. 16 is a perspective view showing an operation of the electrically operated bed, where the coordinate ($\alpha$,$\beta$) is (40, 25)
Figure 17:
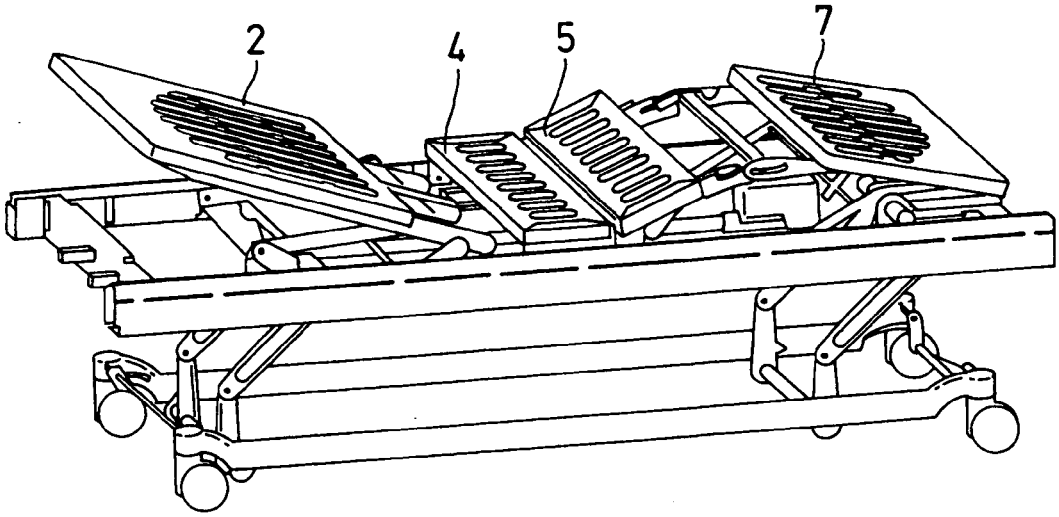
FIG. 17 is a perspective view showing an operation of the electrically operated bed, where the coordinate ($\alpha$,$\beta$) is (19, 25)
Figure 18:
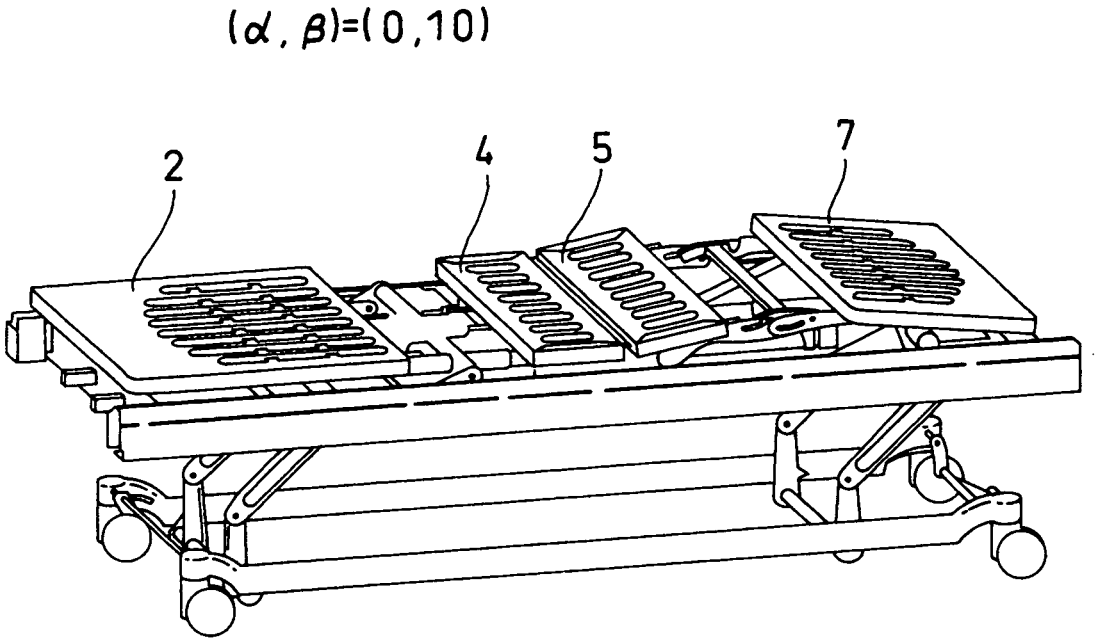
FIG. 18 is a perspective view showing an operation of the electrically operated bed, where the coordinate ($\alpha$,$\beta$) is (0,10)

Next, an embodiment of the present invention will be described in detail with reference to the attached diagrams. FIG. 1 is a perspective view showing the electrically operated bed according to an embodiment of the present invention; FIG. 2 is a top view showing a back bottom, a knee bottom, and a feet bottom of the electrically operated bed, as well as bending portions therebetween; FIG. 3 is a front view of the portions shown in FIG. 2; FIG. 4 is a front view showing a back-raising device when the back bottom is horizontal; FIG. 5 is a front view showing a back-raising device when the back bottom is raised; FIG. 6 is a front view showing a knee-raising device when the knee bottom is horizontal; FIG. 7 is a front view showing a knee-raising device when the knee bottom is raised; and FIGS. 8 through 18 are a perspective view showing operations of the electrically operated bed.

As shown in FIGS. 1 through 3, a back bottom 2, a back bending portion 3, a waist bottom 4, a knee bottom 5, a knee bending portion 6, and a feet bottom 7 are attached, in the stated order, to the electrically operated bed according to the present embodiment. The back bottom 2 is attached to the waist bottom 4 via the back bending portion 3, which is bendable; and the knee bottom 5 is attached to the feet bottom 7 via the knee bending portion 6, which is similarly bendable. The waist bottom 4 is fixed. The back bottom 2 rotates so that a head-side distal end of the back bottom 2 is raised, rotates in the opposite direction so as to return to a horizontal position, and pivots about the side towards the back bending portion 3. The knee bottom 5 rotates so that a distal end towards the knee bending portion 6 is raised, rotates in the opposite direction so as to return to a horizontal position, and pivots about the side towards the waist bottom 4. The back bending portion 3 and the knee bending portion 6 comprise a plurality of slats disposed parallel to one another in a manner reminiscent of window blinds, wherein the slats are connected to one another so that gaps therebetween can be changed; the entirety of the back bending portion 3 and the knee bending portion 6 can be stretched and shrunk in the direction of the connection between the slats, and bent continuously and smoothly in the direction of the connection between each of the slats. A push-button for a switch for indicating a back-raising operation or a back-lowering operation is installed in an operation box 11. A control box 12 that accommodates a control device for controlling the operation of the electrically operated bed 1 and into which an instruction signal from the operation box 11 is inputted, is installed under the feet bottom 7.

A frame (not shown) that supports the back bottom 2 and other components is provided to the electrically operated bed 1 so that an actuator (not shown) can move the frame up and down, thereby allowing the height of the bed to be adjusted.

As shown in FIGS. 2 and 3, a back-raising device 20 for raising the back bottom 2, and a knee-raising device 40 for raising the knee bottom 5, are installed under the back bottom 2, the back bending portion 3, the waist bottom 4, the knee bottom 5, the knee bending portion 6, and the feet bottom 7.

As shown in FIGS. 4 and 5, in the back-raising device 20, a pair of parallel support rods 21 extending in the lengthways direction of the bed are fixed onto the bottom surface of the back bottom 2 and support the back bottom 2. A pair of parallel first links 23, also extending in the lengthways direction of the bed, are also provided so as to be rotatable about a fixed fulcrum F1. A distal end of the first link 23 and a section of the support rods 21 towards the waist bottom 4 are connected by a mobile fulcrum M1. A second link 24 is also provided so as to be rotatable about a fixed fulcrum F2, and a distal end of the second link 24 is connected via a mobile fulcrum M3 to a section on the support rods 21 further towards the waist bottom 4 in relation to the mobile fulcrum M1. A protrusion 22 that protrudes downwards is provided to the support rods 21 at a position towards the waist bottom 4, and a third link 25 is connected via a mobile fulcrum M2 to a distal end of the protrusion 22. The third link 25 is connected via a mobile fulcrum M4 to a piston rod 27 of an actuator 28 for raising the back. A fourth link 26 is rotatably supported via a fixed fulcrum F3 by the waist bottom 4, and a distal end of the fourth link 26 is connected to the mobile fulcrum M4, which is a connection point between the third link 25 and the piston rod 27. Meanwhile, a back end of the actuator 28 is rotatably supported by a fixed fulcrum F6, and an allowance is made for the direction of deployment and retraction of the piston rod 27 to deviate moderately from horizontal.

As shown in FIG. 6 and FIG. 7, in the knee-raising device 40, a support section 41 is fixed to a bottom surface of the knee bottom 5, and a support section 42 is fixed to a bottom surface of the feet bottom 7. The knee bottom 5 and the waist bottom 4 are connected by a fixed fulcrum F4 so as to be mutually rotatable. The waist bottom 4 is fixed, so the knee bottom 5 pivots via a fixed fulcrum F5. The support section 41 extends towards the direction of the feet bottom 7, and the support section 42 extends towards the direction of the knee bottom 5. Sections where the support section 41 and the support section 42 approach each other are mutually connected by a mobile fulcrum M5 below the knee bending portion 6. As shown in FIG. 6, when the knee bottom 5 and the feet bottom 7 are in a horizontal state, the support section 41 and the support section 42 separate from the knee bending portion 6, and as shown in FIG. 7, when the knee bottom 5 is in a raised state, the support section 41 and the support section 42 bend so that the top edges of the support sections form an arc, and support the similarly bent knee bending portion 6 from below. A fifth link 43 is pivotally supported on the fixed fulcrum F5, and a section of the feet bottom 7 towards the distal end (of the feet bottom 7) is connected via a mobile fulcrum M7 to a distal end of the fifth link 43. A section 44 of the support section 41 that is on the opposite side relative to the support section 42 extends towards the direction of the waist bottom 4, and a piston rod 46 of an actuator 45 for knee-raising is connected via a mobile fulcrum M6 to a distal end of the section 44. Meanwhile, a back end of the actuator 45 is rotatably supported by a fixed fulcrum F7, and an allowance is made for the direction of deployment and retraction of the piston rod 46 to deviate moderately from horizontal.

A fixed fulcrum described in this patent specification is one whose position is fixed and does not move; a link pivotally supported by a fixed fulcrum is rotatable relative to the fixed fulcrum. The fixed fulcrums are fixed in relation to a frame supporting the back bottom 2 and similar elements; when the entire frame moves up or down and the height of the bed changes, the fixed fulcrums move up and down with the frame. A mobile fulcrum is one which moves due to a turning motion of a link.

Each of the actuators 28, 45 is installed with a motor; the forward or reverse rotations of the motor deploying or retracting the piston rods 27, 46. The actuators 28, 45 are controlled by a control device (not shown in FIG. 2) inside the control box 12. Pressing a switch on the operation box 11 outputs a signal which is inputted into the control device inside the control box 12 using a serial communication method.

Figure 19:
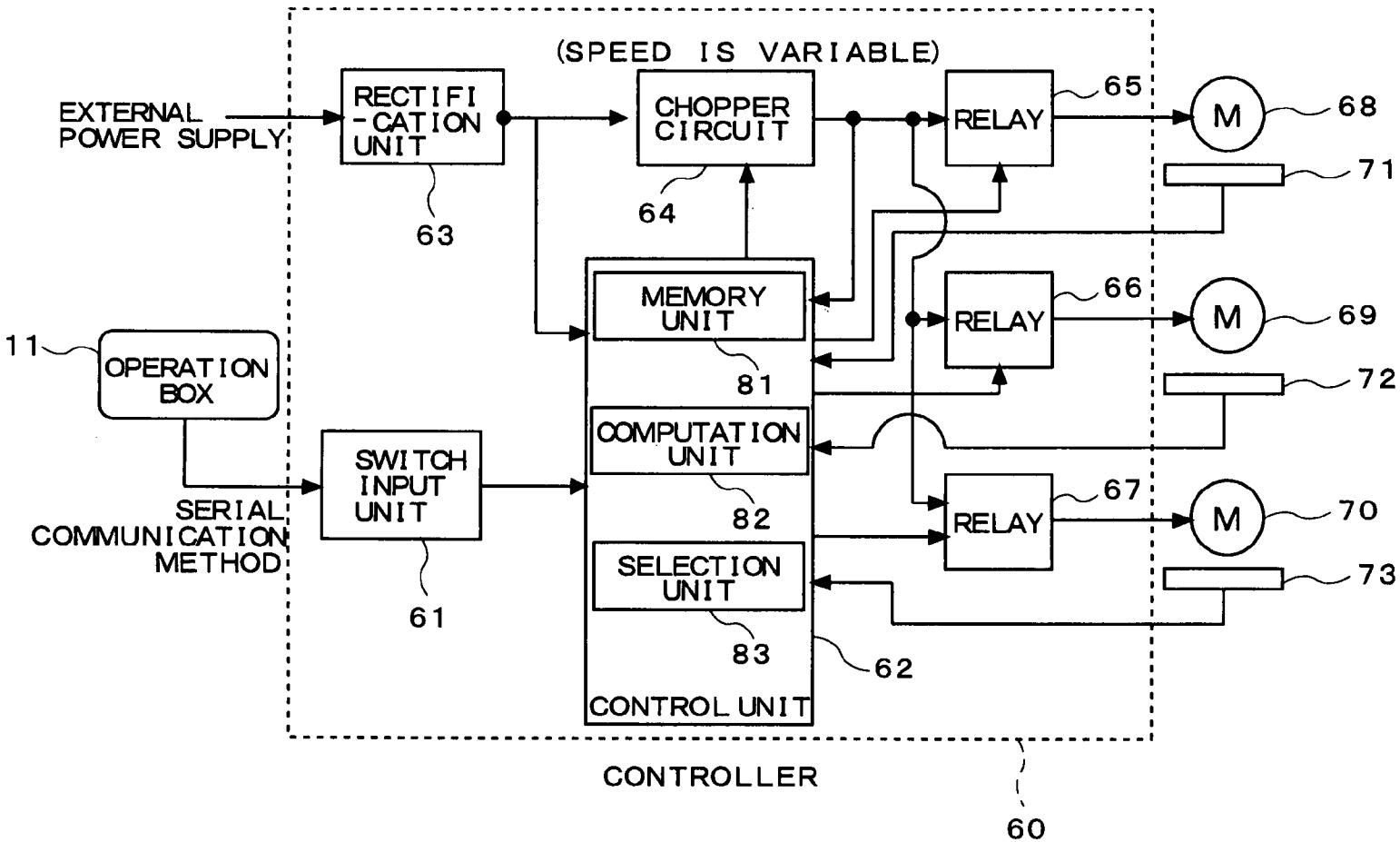
FIG. 19 is a block drawing showing a controlling device according to an embodiment of the present invention.

FIG. 19 is a block diagram showing the configuration of the control device 60. The on/off switch signal inputted from the operation box 11 is inputted to an input unit 61, and then inputted to a control unit 62. A power supply current is inputted into a rectification unit 63, converted to a 5 V direct current, and supplied to a chopper circuit 64 and the control unit 62. The control unit 62 outputs to the chopper circuit 64 a control signal for driving each of the actuators.

The chopper circuit 64 outputs a pulse-width modulated (PWM) signal to a motor 68 installed in the actuator (not shown) for adjusting the height of the bed, a motor 69 installed in the actuator 28 of the back-raising device 20, and a motor 70 installed in the actuator 45 of the knee-raising device 40. The control signal is outputted to the motor 68, the motor 69, and the motor 70, through a relay 65, a relay 66, and a relay 67 respectively. The output signal of the chopper circuit 64 is also inputted into the control unit 62, feeding back the control signal to the control unit 62. A control signal from the control unit 62 is inputted into the relays 65, 66, 67; and controls the on/off state of the relays 65, 66, 67. A detection signal from each of a sensor 71 for detecting the position (deployment/retraction position) of a piston rod for the actuator for moving the bed up or down, a sensor 72 for detecting the position (deployment/retraction position) of the piston rod 27 of the actuator 28 of the back-raising device 20, and a sensor 73 for detecting the position (deployment/retraction position) of the piston rod 46 of the actuator 45 of the knee-raising device 40, is inputted into the control unit 62. The sensors 71, 72, 73 detect the position of a piston rod. An example of a method of detecting the position of a piston rod is a potentiometer that measures resistance which changes as the piston rod is deployed or retracted; another example is a method that detects the extent of rotation of the motor, or determines the extent of rotation of the motor by controlling the speed of motor rotation to a predetermined speed and multiplying this speed of motor rotation with the duration of (motor) movement, thereby detecting the position of the piston rod. Examples of a sensor for detecting the extent of rotation of the motor include a sensor in which a slitted circular disc is attached to a motor rotation shaft or another motion mechanism, whereby the angle or number of rotation is measured using light from a light-emitting diode being blocked by, or passing through, the slitted circular disc; a sensor that measures the number of rotation magnetically using a Hall element; and a potentiometer that measures resistance which changes as the motor rotates. Examples of a sensor for controlling the rotation speed of the motor include a sensor in which a back electromotive force caused by the rotation of the motor is detected and power is controlled, thereby making the motor rotate at a constant speed, and the duration of (motor) movement at this rotation speed is multiplied by the value of the speed so that the extent of motor rotation is determined; and a sensor in which the motor is connected to a tachogenerator (electrical generator), a generated voltage is detected, power is controlled so that the motor rotates at a constant speed, and the duration of (motor) movement at this rotation speed is multiplied by the value of the speed so that the extent of motor rotation is determined.

The control unit 62 comprises a memory unit 81, a selection unit 83, and a computation unit 82; and a plurality of patterns of back-raising and back-lowering is stored in the memory unit 81. The pattern data can be pre-stored in a read-only memory (RAM), or stored in a random access memory (RAM) so that the data can be renewed from outside.

The plurality of patterns comprises patterns that vary depending on body height or another physical attribute of a user of the bed; a type, characteristic, or other attribute of a mattress; or difference in a final target point ($\alpha_0$, $\beta_0$) to be reached via a back-raising action; and are patterns that are most suited to each characteristic. Alternatively, the plurality of patterns comprises a pattern that is most suited to a preference of the patient.

For example, a plurality of types of patterns, each of which being most suited to a mattress characteristic, is stored in the memory unit. The mattress characteristic is the thickness, elastic resilience, or other characteristic of the mattress; and a most suitable operation pattern for each of such characteristics is stored in the memory unit 81.

Such operational patterns may vary depending on a physical characteristic of the patient. For example, a most suitable operational pattern may be provided to each of categories of height (e.g., 140 cm to 150 cm, 150 cm to 160 cm, 160 cm to 170 cm, 170 cm to 180 cm, 180 cm to 190 cm, etc.) of the bed user. Alternatively, a most suitable pattern may be provided for each of varying body weights, or a most suitable pattern may be provided for each of varying body mass indices (BMI). Or, a most suitable pattern may be provided for each of ranges of motion (angle) of a knee joint and other ranges of motion (ROM). A pattern that varies to suit a preference of the patient can also be set to the plurality of patterns. In such an instance, for example, the back angle $\alpha_0$ is set to a maximum of 75°, the knee angle $\beta$ when the back angle $\alpha_0$ is at the maximum is set to 0°, 10°, and 15°, and a plurality of types of most suitable operation patterns, through which each of the final orientations is to be reached, is set in accordance with a preference of the patient. With such patterns that are suited to preferences of patients, preferred operation patterns are summarized into several types of patterns by using a large number of samples for the study (a large number of people in a study sample).

Figure 20:
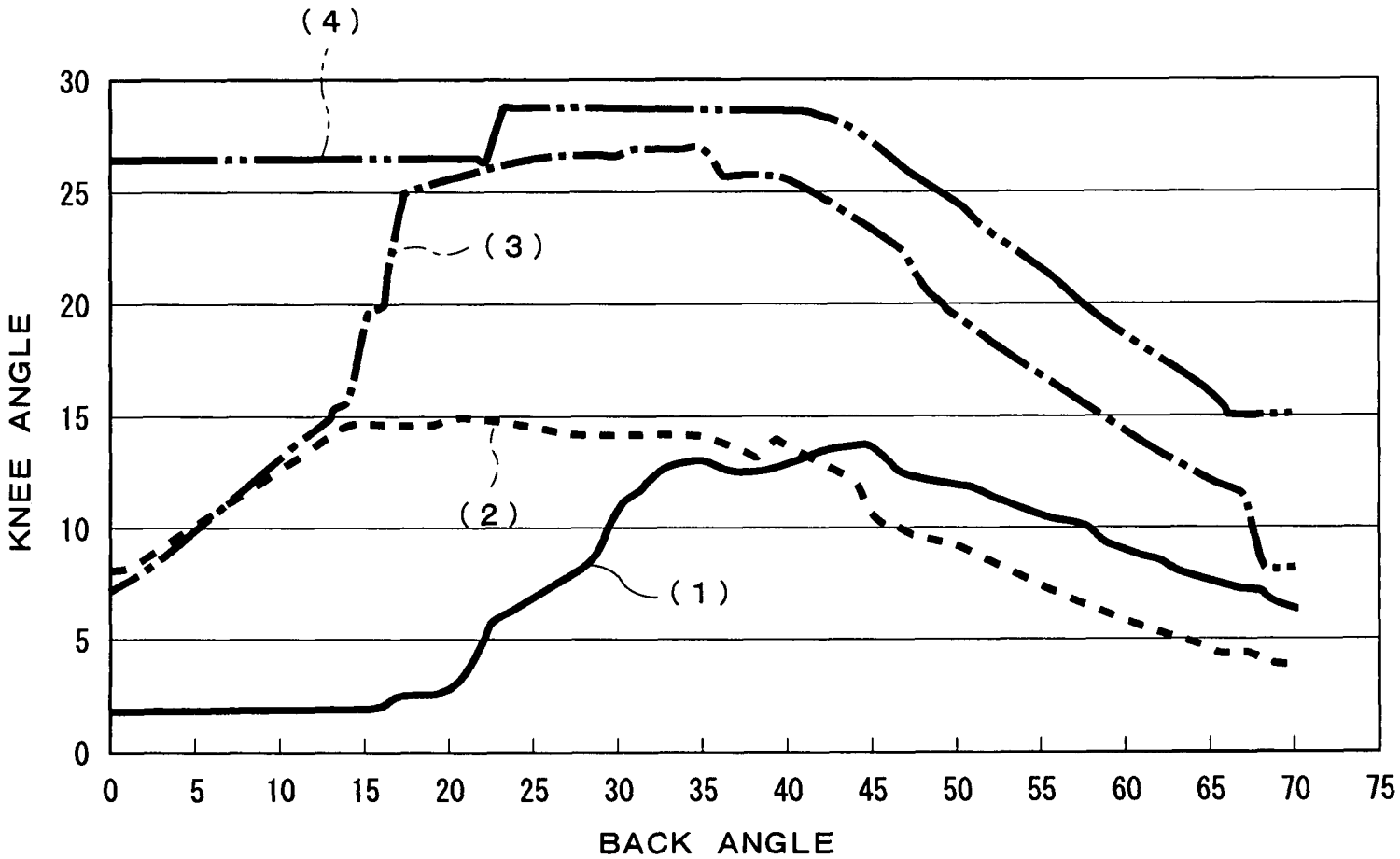
FIG. 20 is a graph showing four operational patterns grouped according to preferences of bed users.
Figure 21:
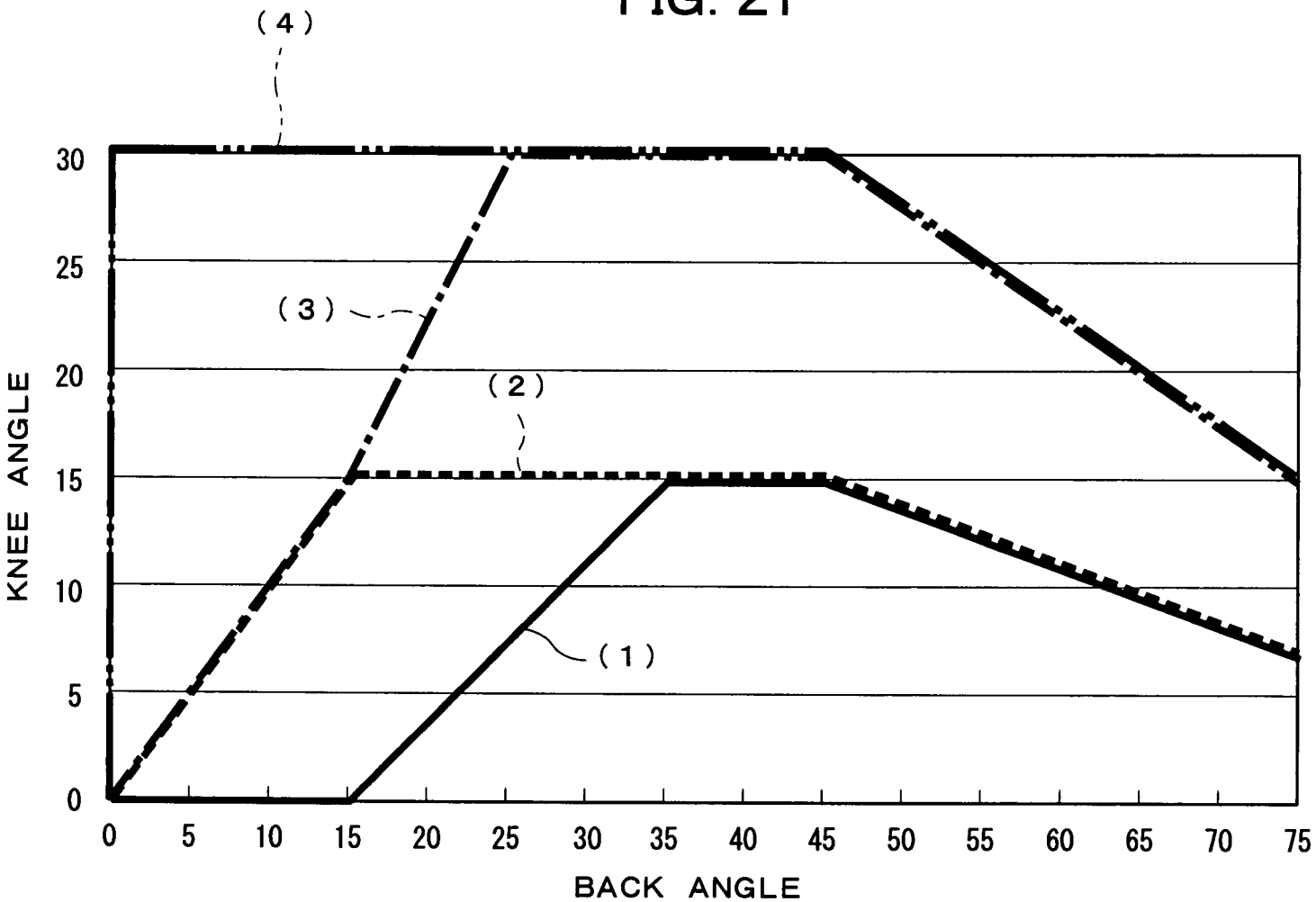
FIG. 21 is a graph showing the operational patterns in FIG. 20 that have been represented by coordinate values and made controllable.

FIGS. 20 and 21 are graphs showing a plurality of patterns stored in the memory unit. FIG. 20 is a graph in which patterns of preferences of twenty patients are determined and statistically treated, and the result shown. Even though there are twenty test subjects, patterns that suit the preferences of the test subjects can be summarized by four patterns shown. The patterns shown in FIG. 20 are approximated to patterns that can be followed by the electrically operated bed and are shown in FIG. 21. The patterns shown in FIG. 21 are expressed using coordinates ($\alpha$,$\beta$) that are themselves expressed using the back angle $\alpha$ and the knee angle $\beta$, and are stored in the memory unit 81. For example, the first pattern shown in FIG. 21 can be expressed using the following five coordinate points: (0,0), (15,0), (35, 15), (45, 15), (75, 7).

The back angle $\alpha$ is an angle of the back bottom 2 against the horizontal direction, and the knee angle $\beta$ is an angle of the knee bottom 5 with respect to the horizontal direction. The angle $\alpha$ is calculated geometrically from the position of the piston rod 27 of the actuator 28, and the angle $\beta$ is calculated geometrically from the position of the piston rod 46 of the actuator 45. Therefore, the respective relationships between the locations of the piston rods 27, 46 of the actuators 28, 45 and the back angle $\alpha$ and the knee angle $\beta$ are determined using a geometrical calculation, the relationships are tabulated in a correspondence table, and data in the correspondence table is stored in the memory unit 81. The computation unit 82 then uses a result of piston rod detection for each of the actuators 28, 45 that are inputted from the sensors 72, 73 to retrieve each of the back angle $\alpha$ and the knee angle $\beta$ from the correspondence table stored in the memory unit 81, and determines the back angle $\alpha$ and the knee angle $\beta$. Subsequently, the computation unit 82 compares the back angle $\alpha$ and the knee angle $\beta$ with a pattern shown in FIG. 20 or FIG. 21, and outputs a control signal to the relays 65, 66, 67 so that the measurement results of the back angle $\alpha$ and the knee angle $\beta$ match the pattern.

As described above, an operation pattern is expressed using a coordinate system ($\alpha$,$\beta$) comprising a back angle $\alpha$ and a knee angle $\beta$, and a plurality of patterns is stored in the memory unit 81. A most suitable pattern is then selected from the memory unit 81 via the selection unit 83 of the control unit 62 according to the height of the patient, the thickness of the mattress, the preference of the patient, or another factor; and the pattern is set to the computation unit 82. A raising pattern by which the back bottom 2 is raised and a lowering pattern by which the back bottom 2 is lowered can be varied.

The pattern selection unit 83 may comprise a switch provided to a bottom surface or a side surface of a hand-operated switch for the electrically operated bed, and may comprise a button that selects a different pattern in order when the button is pressed, or a button provided for each of the patterns. Alternatively, a switch button may be installed in a controlling box for the electrically operated bed. Or, the pattern may be switched using an external terminal. A switching device may be provided to a nurse station, and the rising/lowering pattern of the electrically operated bed switched by remote control via a connection (or a local area network, LAN). Or, instead of directly sending a pattern switching signal over the connection or the LAN, the height of the patient or another attribute may be sent to the bed for the patient, and the pattern selected via the selection unit 83. Or, the height of the patient lying on the bed may be measured using an image sensor or a photoelectric sensor, and the pattern selected by the selection unit 83 based on the measurement result. Or, the weight of the patient on the bed may be measured using a load cell or another device, and the pattern selected by the selection unit 83 based on the measurement result. Or, an IC tag or another information medium may be installed on the mattress, and read by a sensor provided to the bed. Or, the IC tag may be installed on the patient.

The operation of the electrically operated bed having the above configuration will now be described. First, the selection unit 83 is used to select, from the patterns stored in the memory unit 81, a most suitable pattern according to a physical characteristic of the patient, a characteristic of the mattress, or a preference of the patient; and the selected pattern is set in the computation unit 82. Then, from a horizontal state shown in FIG. 4, the actuator 28 is operated and the piston rod 27 is deployed, whereupon, as shown in FIG. 5, the fourth link 26 turns clockwise, and the third link 25 acts to rotate the protrusion 22 of the support rod 21 of the back bottom 2 clockwise, because the fixed fulcrums F1, F2, F3 do not move. Since the first link 23 and the second link 24 pivotally supported by the fixed fulcrums F1, F2 are connected to the support rods 21 via the mobile fulcrum M1 and mobile fulcrum M3 respectively, the back bottom 2 can turn in a rising motion, with the two points M1, M3 as centers of turn, due to the combined action of the long first links 23 and the short second link 24. Therefore, when the piston rod 27 moves forward (in a deploying motion), the third link 25 pushes the protrusion 22 of the support rod 21, thereby turning the support rods 21 and the back bottom 2 clockwise about the two points. The back bottom 2 rises as shown in FIG. 5, and a section between the back bottom 2 and the fixed waist bottom 4 bends smoothly due to the back bending portion 3 (not shown in FIG. 5).

Meanwhile, when the piston rod 27 of the actuator 28 is moved in a retracting motion, the third link 25 pulls the protrusion 22, and the support rods 21 and the back bottom 2 return to a horizontal state. The back bottom 2, the back bending portion 3, and the waist bottom 4 thereby return to a horizontal state as shown in FIG. 4.

In the knee-raising device 40, when the piston rod 46 of the actuator 45 is in a deployed state as shown in FIG. 6, the knee bottom 5, the knee bending portion 6, and the feet bottom 7 are in a horizontal state. Retracting the piston rod 46 of the actuator 45 causes the knee bottom 5 and the support section 41 to turn counterclockwise about the fixed fulcrum F4, as shown in FIG. 7. As a result, the knee bottom 5 rises. Here, the knee bottom 5 is connected to the feet bottom 7 via the support section 41 and the support section 42, and the feet bottom 7 is connected to the fifth link 43, which is connected to the fixed fulcrum F5. As a result, when the knee bottom 5 rises, the support section 42 is raised, and the feet bottom 7, whose back section is connected to the fifth link 43, moves upwards while rotatably supported by the mobile fulcrums M5, M7. Here, the knee bottom 5 and the feet bottom 7 are connected by the knee bending portion 6, the bottom section of the knee bending portion 6 is supported by the support sections 41, 42, and the knee bending portion 6 is bent smoothly along an envelope formed by top edges of the support section 41 and the support section 42.

In the back-raising action and the back-lowering action as described above, movements are coordinated and proceed simultaneously, the back bottom 2 and the knee bottom 5 (and the feet bottom 7 following the knee bottom 5) moving as shown in FIGS. 8 through 18. FIGS. 8 through 13 show an example of a pattern during back-raising in which ($\alpha$,$\beta$) moves from (0,0) to (75,0), and FIGS. 13 through 18 show an example of a pattern during back-lowering in which ($\alpha$,$\beta$) moves from (75,0) to (0,10).

Figure 22:
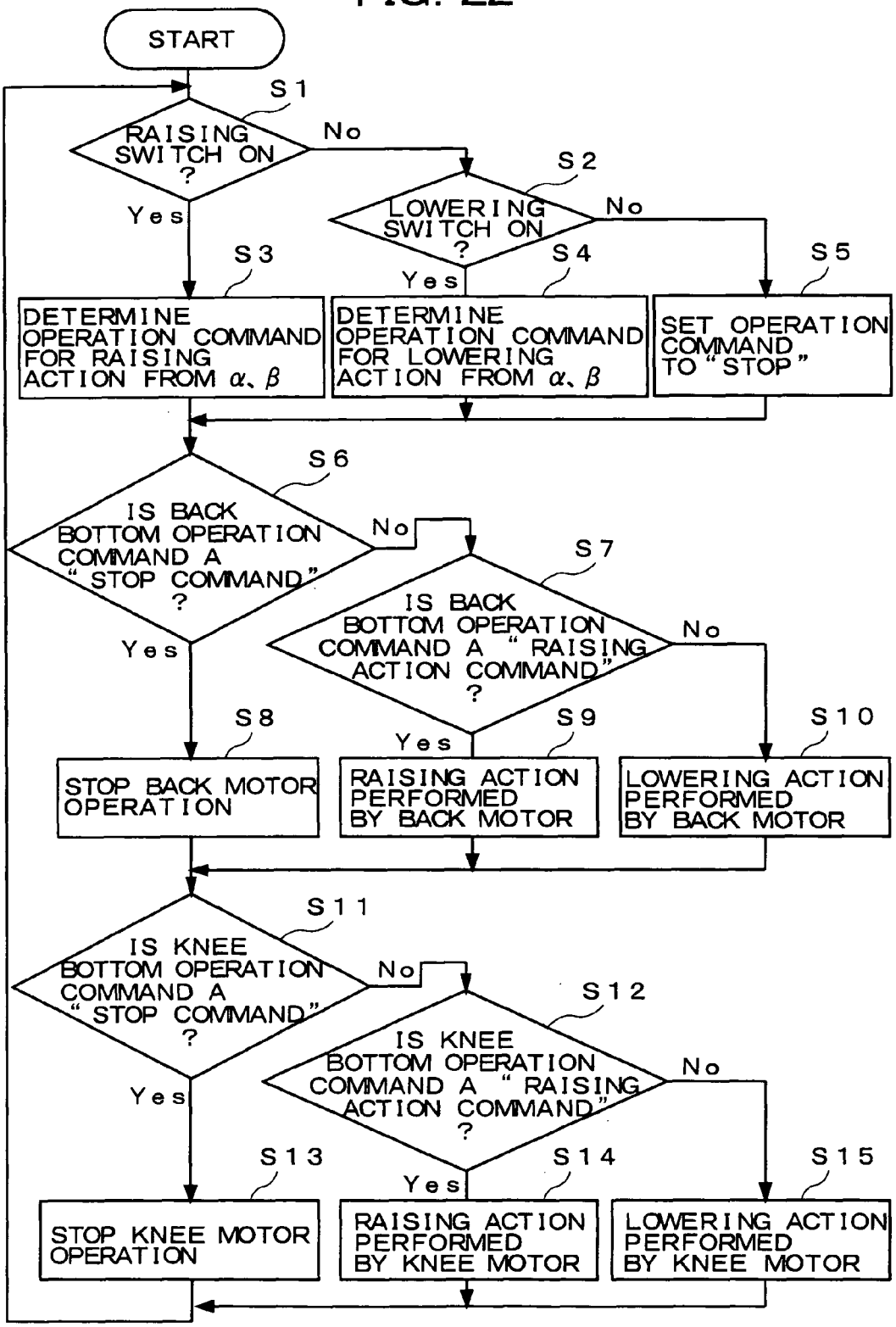
FIG. 22 is a flow chart of the control unit.

The back-raising device 20 and the knee-raising device 40 operate in coordination with one another, as described below, so that the back angle $\alpha$ and the knee angle $\beta$ change according to a pattern shown in FIG. 21. FIG. 22 is a flowchart showing an operation of the control unit 62 from FIG. 19.

When a signal indicating a start of a back-raising operation is inputted from the operation box 11 to the control unit 62, the computation unit 82 of the control unit 62 selects from the memory unit 81 a raising pattern shown in FIG. 20 since "YES" will be decided in step S1 in FIG. 22. Then, the computation unit 82 uses the correspondence chart stored in the memory unit 81 to retrieve and ascertain the back angle $\alpha$ of the back bottom 2 and the knee angle $\beta$ of the knee bottom 5 from a detection signal that is inputted into the control unit 62 from the sensors 72, 73.

Then, the current back angle $\alpha$ and the knee angle $\beta$ are compared with the raising pattern in FIG. 20, and an operation command for the actuators 28, 47 is determined (step 33). The operation command is a "stop command", a "raising action command", or a "lowering action command" for the back bottom 2 or the knee bottom 5.

When the computation unit compares the measured values for the back angle $\alpha$ and the knee angle $\beta$ with the raising pattern, and the back angle $\alpha$ matches the angle indicated by the raising pattern, the "stop command" is issued to the back bottom; when the back angle $\alpha$ is smaller than the angle indicated by the raising pattern, the "raising action command" is issued to the back bottom; and when the back angle $\alpha$ is larger than the angle indicated by the raising pattern, the "lowering action command" is issued to the back bottom. Similarly, for the knee bottom, when the knee angle $\beta$ matches the angle indicated by the raising pattern, the "stop command" is issued to the knee bottom; when the knee angle $\beta$ is smaller than the angle indicated by the raising pattern, the "raising action command" is issued to the knee bottom; and when the knee angle $\beta$ is larger than the angle indicated by the raising pattern, the "lowering action command" is issued to the knee bottom.

Meanwhile, if the starting signal sent from the operation box 11 is a signal indicating the start of a back-lowering operation, the signal moves to a step S2 in FIG. 22 since "NO" will have been decided in step S1. In step S2, "YES" is decided because the starting signal is a signal indicating a back-lowering operation, and the computation unit 82 selects from the memory unit 81 a lowering pattern in FIG. 21. Again, the back angle $\alpha$ and the knee angle $\beta$ are determined and compared with a lowering pattern in FIG. 21, and an operation command for the actuator 28, 47 is determined (step S4). The operation command is a "stop command", a "raising action command", or a "lowering action command" for the back bottom 2 and the knee bottom 5.

When the computation unit compares the measured values for the back angle $\alpha$ and the knee angle $\beta$ with the lowering pattern, and the back angle $\alpha$ matches the angle indicated by the lowering pattern, the "stop command" is issued to the back bottom; when the back angle $\alpha$ is smaller than the angle indicated by the lowering pattern, the "lowering action command" is issued to the back bottom; and when the back angle $\alpha$ is larger than the angle indicated by the lowering pattern, the "lowering action command" is issued to the back bottom. Similarly, for the knee bottom, when the knee angle $\beta$ matches the angle indicated by the lowering pattern, the "stop command" is issued to the knee bottom; when the knee angle $\beta$ is smaller than the angle indicated by the lowering pattern, the "raising action command" is issued to the knee bottom; and when the knee angle β is larger than the angle indicated by the lowering pattern, the "lowering action command" is issued to the knee bottom.

If the signal inputted into the control unit 62 from the operation box 11 via the input unit 61 indicates neither a start of a back-raising operation nor a start of a back-lowering operation, operation commands for both the back bottom and the knee bottom are determined to be "stop command" (step S5).

Then, at a step S6 in FIG. 22, if the operation command of the back bottom is a "stop command," the computation unit 82 outputs a control signal to the relay 66 of the actuator for the back bottom and stops the motor 69 (step S8). If the operation command of the back bottom is not a "stop command", a step S7 determines whether or not the operation command of the back bottom is a raising action command; if the operation command is a raising action command ("YES"), the computation unit 82 outputs a control signal to the relay 66, causing the motor 69 to turn in a direction that increases the back angle α of the back bottom 2 (step S9). If the operation command is a lowering action command ("NO"), the computation unit 82 outputs a control signal to the relay 66, causing the motor 69 to turn in a direction that decreases the back angle α of the back bottom 2 (step S10).

Meanwhile, in a step S11 of FIG. 22, if the operation command of the knee bottom is a "stop command", the computation unit 82 outputs a control signal to the relay 67 of the actuator for the knee bottom and stops the motor 70 (step S13). If the operation command of the knee bottom is not a "stop command", a step S12 determines whether or not the operation command of the bottom knee bottom is a raising action command; if the operation command is a raising action command ("YES"), the computation unit 82 outputs a control signal to the relay 67, causing the motor 70 to turn in a direction that increases the knee angle β of the knee bottom 5 (step S14). If the operation command is a lowering action command ("NO"), the computation unit 82 outputs a control signal to the relay 67, causing the motor 70 to turn in a direction that decreases the knee angle β of the knee bottom 5 (step S15).

By returning to step S1 and repeating the flow at an appropriate interval, the back bottom 2 and the knee bottom 5 perform a raising action or a lowering action according to a pattern shown in FIG. 20 and FIG. 21. After step S15, the flow returns to steps S1, S2, the on/off state of the back-raising switch is ascertained, and the on/off state of the back-lowering switch is ascertained; therefore, as long as the back-raising switch is always on, the back-raising action proceeds, and as long as the back-lowering switch is always on, the back-lowering action proceeds. When the back-raising switch or the back-lowering switch is switched off during an operation, the operation command at step S5 becomes always "stop", and all actions terminate. Therefore, in order to proceed continuously with the back-raising action, the operator is required to keep the back-raising switch switched on; if a push button is used, the push button must be continuously pressed. A similar requirement applies during a back-lowering action. If the back-raising switch and the back-lowering switch are switched on simultaneously, action is always terminated, although not shown in the flow chart of FIG. 22. Setting the operations of the switches as above improves safety.

A signal indicating start of a back-raising action (back-raising operation) or a signal indicating start of a back-lowering action (back-lowering operation) is inputted from the control unit 62 of the control device 60 from the operation box 11; here, a switch for starting a back-raising action (first switch) and a switch for starting a back-lowering action (second switch) may be provided separately in a push-button format, or a switch which tilts left or right to select a neutral position in the center, a back-raising action, or a back-lowering action, may be provided.

In the embodiment described above, the back angle α of the back bottom 2 with respect to the horizontal and the knee angle β of the knee bottom 5 with respect to the horizontal are calculated geometrically from the position of the piston rod 27 of the actuator 28 and the position of the piston rod 46 of the actuator 45 respectively; the relationship between positions of the piston rods 27, 46 and the back angle α and the knee angle β respectively are pre-stored in a correspondence table; the data in the correspondence table is stored in the memory unit 81; and the computation unit 82 uses a measurement result for location of the piston rod of each of the actuators 28, 45 inputted from the sensors 72, 73, to retrieve the back angle α and the knee angle β from the correspondence table stored in the memory unit 81, ascertains the back angle α and the knee angle β, compares the back angle α and the knee angle β with a pattern shown in FIG. 20 or FIG. 21 (stored in the memory unit 81), and controls driving of the back bottom 2 and the knee bottom 5 so that the measurement results of the back angle α and the knee angle β match the pattern.

However, driving of the back bottom 2 and the knee bottom 5 can be controlled using an alternative method, in which the measurement result for the piston rod position is used to directly control each of the actuators, and control the driving of the back bottom 2 and the knee bottom 5. Specifically, a position a of the piston rod 27 of the actuator 28 for driving the back bottom when the back angle α is, for example, at each of 0°, 40°, 47°, 60°, 75° in FIG. 20 may be pre-determined using a geometrical calculation; a position b of the piston rod 46 of the actuator 45 for driving the knee bottom when the knee angle β is, for example, at each of 0°, 25°, 15°, 0° in FIG. 20 may be pre-determined using a geometrical calculation, and a most suitable pattern in the coordinate (a,b) is stored in the memory unit. When the positions of the piston rods 27, 46 are detected using sensors 72, 73, the result from having detected the position of each of the piston rods 27, 46 is directly compared with the most suitable pattern in the coordinate (a,b), whereby each of the actuators may be driven so that the position of each of the piston rods 27, 46 moves to a position designated by the coordinate (a,b). In such an instance, a pattern in a coordinate (a,b) using locations of the piston rods, instead of a (α,β) pattern using the back angle α and the knee angle β in FIG. 20 and FIG. 21, is recorded in the memory unit 81.

Alternatively, a height of the position of a section towards a distal end of the back bottom 2 when the back bottom 2 is turning, and a height of the position of a section towards a distal end of the knee bottom 5 (an end section towards the knee bending portion 6) when the knee bottom 5 is turning, may be detected using a light sensor, an ultrasound sensor, or another sensor; and the driving of the back bottom 2 and the knee bottom 5 controlled according to a pattern shown in FIG. 20 and FIG. 21, based on the detected heights. Again, in such an instance, the height position may be converted to a back angle α and a knee angle β, and the driving (of the back bottom and the knee bottom) controlled so that the back angle α and the knee angle β changes according to a pattern shown in FIG. 20 and FIG. 21; or a most suitable pattern that uses height positions of the back bottom 2 and the knee bottom 5 as coordinate points may be created, and the driving of the back bottom 2 and the knee bottom 5 controlled by directly comparing the most suitable pattern that uses the height positions as coordinate points with a detection result for the height position.

The present application claims the priority of Japanese Patent Application No. 2007-062572, filed on Mar. 12, 2007, whose disclosure is included here in its entirety.

INDUSTRIAL APPLICABILITY

The present invention can be suitably applied as an electrically operated bed used in a hospital or a care facility, and can be suitably applied as an electrically operated bed wherein a back section of the bed can be raised electrically, and the back section of the bed can be raised when a patient or another person being cared for is in a lying state without their being displaced or subjected to a sense of pressure.

The invention claimed is:

1. An electrically operated bed, comprising:

a back bottom;

a knee bottom;

a drive unit for swinging said back bottom and said knee bottom up or down; and a control unit for controlling said drive unit so that a back angle α, which is an angle of elevation of said back bottom from a horizontal state, and a knee angle β, which is an angle of elevation of said knee bottom from a horizontal state, change according to a pre-set pattern;

wherein the control unit comprises:

a memory unit for storing a plurality of raising patterns and a plurality of lowering patterns for linking with a plurality of points a coordinate point (0,0) in a (α,β) coordinate, in which each of the bottoms is in a horizontal state, and a coordinate point (α0, β0), in which the back bottom is raised;

a selection unit for selecting one pattern from the plurality of raising patterns and said plurality of lowering patterns stored in the memory unit; and a computation unit for controlling said drive unit so that said back angle α and said knee angle β change according to the pattern selected by the selection unit, wherein said plurality of patterns and said plurality of lowering patterns vary depending on one of a height or another physical attribute of a bed user, and wherein a most suitable pattern for the bed user or the mattress is automatically selected from the memory unit via the selection unit according to the height or said another physical attribute of the bed user.

2. The electrically operated bed according to claim 1, wherein said plurality of patterns vary in terms of a coordinate point (α0, β0) to which said back bottom is raised.

3. The electrically operated bed according to claim 1, wherein said computation unit controls said drive unit to prevent the bed user from being displaced when the back bottom is being raised and lowered.

4. A method for controlling pivoting of a back bottom and a knee bottom of an electrically operated bed having a vertically pivoting back bottom and a knee bottom, the method comprising:

driving and pivoting said back bottom and said knee bottom so as to change a back angle α, which is an angle of elevation of said back bottom from a horizontal state, and a knee angle β, which is an angle of elevation of said knee bottom from a horizontal state, according to a pre-set pattern of the back angle α and the knee angle β, the patterns linking a coordinate point (0,0) in which the back bottom and the knee bottom are in a horizontal state, and a coordinate point (α0, β0) in which the back bottom is raised, where a combination of said α and said β is expressed using a (α, β) coordinate;

preparing a plurality of raising patterns and a plurality of lowering patterns, the plurality of raising patterns and the plurality of lowering patterns linking a coordinate point (0,0) in which the back bottom and the knee bottom are in a horizontal state, and a coordinate point (α0, β0) in which the back bottom is raised, where a combination of said α and said β is expressed using a (α,β) coordinate;

selecting the pre-set pattern from the plurality of raising patterns and said plurality of lowering patterns; and controlling the pivoting of said back bottom and the knee bottom so that said back angle α and said knee angle β change according to the selected pre-set pattern, wherein said plurality of raising patterns and said plurality of lowering patterns vary depending on one of a height or another physical attribute of a bed user, and wherein a most suitable pattern for the bed user or the mattress is automatically selected from the plurality of raising patterns and said plurality of lowering patterns according to the height or said other physical attribute of the bed user.

5. The method for controlling an electrically operated bed according to claim 4, wherein said plurality of patterns vary in terms of a coordinate point (α0, β0) to which the back bottom is raised.

6. An electrically operated bed, comprising:

a back bottom, a knee bottom connected to the back bottom via a drive unit; and a control unit for controlling said drive unit so that a back angle α, which is an angle of elevation of said back bottom from a horizontal state, and a knee angle β, which is an angle of elevation of said knee bottom from a horizontal state, change according to a pre-set pattern;

wherein the control unit comprises:

a memory unit for storing a plurality of raising patterns and a plurality of lowering patterns for linking with a plurality of points a coordinate point (0,0) in a (α,β) coordinate, in which each of the bottoms is in a horizontal state, and a coordinate point (α0, β0), in which the back bottom is raised, wherein said plurality of raising patterns and said plurality of lowering patterns vary depending on one of a height or another physical attribute of a bed user;

a selection unit for selecting a suitable pattern from the plurality of raising patterns and the plurality of lowering patterns stored in the memory unit, the suitable pattern being chosen based on the height or said another physical attribute of a patient lying on the bed, and the pattern selected based on the measurement result; and a computation unit for controlling said drive unit so that said back angle α and said knee angle β change according to the pattern selected by the selection unit.

7. The bed according to claim 6, wherein the selected pattern is set in the computation unit.

* * * * *